United States Patent [19]

Füsser et al.

[11] 4,442,694

[45] Apr. 17, 1984

[54] FLOOR-MOUNTED FORGING PRESS HAVING A STATIONARY PISTON WITH A BORE FOR SUPPLYING A PRESSURE MEDIUM, AND A MOVING CYLINDER

[75] Inventors: Hermann Füsser, Haan; Horst Groos, Metzkausen; Heinz Schmoll, Kaarst, all of Fed. Rep. of Germany

[73] Assignee: SMS Schloemann-Siemag Aktiengesellschaft, Dusseldorf, Fed. Rep. of Germany

[21] Appl. No.: 326,368

[22] Filed: Dec. 1, 1981

[30] Foreign Application Priority Data

Dec. 6, 1980 [DE] Fed. Rep. of Germany ..... 3046110
Dec. 13, 1980 [DE] Fed. Rep. of Germany ..... 3047068

[51] Int. Cl.[3] ..... B21J 9/18

[52] U.S. Cl. ..... 72/453.01; 100/269 R; 92/117 A; 92/118; 72/456; 72/453.05; 72/453.07; 72/453.18; 72/453.14

[58] Field of Search ..... 72/453.01, 453.18, 453.14, 72/453.05, 453.07, 456; 100/214, 269 R; 91/216 R; 92/167, 117 R, 117 A, 118

[56] References Cited

U.S. PATENT DOCUMENTS

| | | | |
|---|---|---|---|
| 2,075,968 | 4/1937 | Von Heydekampf | 100/269 R |
| 2,085,695 | 6/1937 | Dinzl | 100/269 R |
| 2,916,987 | 12/1959 | Hänni | 100/269 R |

*Primary Examiner*—Francis S. Husar
*Assistant Examiner*—David B. Jones
*Attorney, Agent, or Firm*—Holman & Stern

[57] ABSTRACT

A floor-mounted forging press has a static piston arranged on the top beam and a cylinder which slides on the piston and forms a toolholder, and a bore extending through the piston for supplying pressure medium to the cylinder. The piston is hollow and is swivelly mounted by means of ball cups at the lower end of the piston and on the top beam and a thrust bearing member between the ball cups, the piston being held in the vertical position on the top beam with the aid of retaining means. One form of retaining means is a partially resilient pressure medium pipe which holds the piston. Alternatively pins, mounted by means of spherical surfaces, suspend the piston by way of a flange on the piston and are resiliently biased to hold the piston against the top beam in a free-play, resilient and freely movable manner, a bore being provided through the ball cups and thrust bearing member.

12 Claims, 8 Drawing Figures

FLOOR-MOUNTED FORGING PRESS HAVING A STATIONARY PISTON WITH A BORE FOR SUPPLYING A PRESSURE MEDIUM, AND A MOVING CYLINDER

BACKGROUND OF THE INVENTION

1. Field of the Invention

The invention relates to a floor-mounted (or push-down) forging press of the kind having a static piston on the top beam of the press and a cylinder which slides on the piston for the forging stroke and acts as a tool-holder, as well as a coaxial bore for supplying pressure medium to the moving cylinder, which bore extends through the top beam and the piston.

2. Description of the Prior Art

Multi-cylinder and single-cylinder forging presses are known wherein eccentric forces occur which may cause lateral movements or skewing of the toolholder, for example of the travelling, beam or cross-head of the press. In an arrangement comprising a stationary cylinder and a movable piston, for enabling these forces to be better absorbed, the piston forces are transmitted to the tool-holder through ball cups and a bearing shoe between them. The faces of the bearing shoe, machined to a barrelled shape, permit lateral movements as well as skewing of the travelling cross-head of the press. In this arrangement, at least two pistons are present in the forging press. In the classical example, a guide ram effects the central guiding of the travelling cross-head. This guide ram is known as a "Davy pin". The pistons move in stationary cylinders. The pressure medium is supplied at the cylinder side, so that the operative face of the piston can be closed off. (See Ernst Müller, "Hydralische Pressen und Druckflüssigkeitsanlagen", Vol. 1: "Schmiedepressen", 3rd. edition, Springer-Verlag, Berlin/Göttingen/Heidelberg, 1962, pp 32–34 and 48–64, in particular page 59 and FIGS. 50 and 51 on page 63).

A disadvantage of the known arrangements is that with the use of ball cups and a bearing shoe for force-transmission, the press cylinder must always be designed to be stationary, so as to ensure supply of pressure medium.

Also known are single-cylinder presses wherein the cylinder executes the stroke movement, whereas the piston is stationary. The cylinder is also guided externally. The piston, firmly inserted in the top beam on the press, must of necessity participate in the guiding action if the machine is set in the ideal manner. From the design point of view, this means that the guides are excessively complicated, and in practice perfect operation can be achieved only if the outer guide of the cylinder is optimally adjusted. In practice, particularly in forging operations, it is very doubtful whether such optimal setting can be achieved with the existing means.

Brief Summary of the Invention

The object of the present invention is, therefore, to supply pressure medium to the cylinder chamber of a moving press cylinder while using ball cups and a bearing member therebetween, and secondly, to avoid the general disadvantages of over-complicated guides and to create conditions wherein, in all operational situations, including the occurrence of wear in the guides, the guide elements i.e. the main stuffing boxes and the glands between the cylinder and the piston are, to a considerable extent, relieved of load, and the wear in these zones is kept extremely light. In this connection, it should be mentioned that guide elements that are in direct contact with the operating medium are critical in that unavoidable abrasion persists in the medium and, despite the use of filters, this can cause damage to precision components such as pumps and control units.

This object is achieved in accordance with the invention, in that the piston is hollow and is articulatedly mounted by means of ball cups, fitted between the bottom of the static piston and the top beam of the press, and a bearing member between the ball cups, the piston being held in the vertical position on the top beam with the aid of a retaining means.

The moving cylinder can be used directly as a tool-holder, and it is guided externally in the press frame. Thus it is possible to dispense with a separate travelling cross-head.

In accordance with one embodiment of the invention, the retaining means for the piston is constituted by a pipe for supplying the pressure medium, which pipe is disposed centrally along the axis of the cylinder and is arranged in a bore in the top beam of the press and is sealed off. The pipe extends through the ball cups and the bearing member and through the bottom of the hollow piston which adjoins the lower ball cup, a further seal being provided between the pipe and the bottom of the piston and the pipe being secured, by a screwed connection for example, either in the top beam or in the bottom of the piston.

Thus it is possible to introduce pressure medium into the chamber of the moving cylinder in the presence of ball cups and a bearing member, through the pipe. In this arrangement, it is not necessary to forego the known advantages accruing from the use of ball cups and a bearing member. These advantages result in the avoidance of unilateral wear of the main stuffing box and gland and of the associated loss of fluid-tightness in the packing, and scoring of the face of the piston.

The centrally arranged pipe may be of such dimensions that skewing and lateral displacement of the piston, resulting from the mode of operation of the press, can be taken up by a deformable seal in the region of the bottom of the piston or near the beam of the press, the pipe being sufficiently rigid to enable lateral displacements of the piston to be taken up by the seal between the bottom of the piston and the pipe.

Alternatively the centrally arranged pipe is of such dimensions that skewing and lateral displacements of the piston, that result from the mode of operation of the press, can be taken up within the elastic range of the pipe. In other words, the wall thickness of the pipe is such that skewing or lateral displacements of the cylinder by way of the piston are taken up directly by the pipe. In this arrangement, the forces that can occur when adjusting the outer cylinder guides in the press frame cause no deformation, so that incorrect settings, relative to the middle of the press, cannot occur. Thus, it is ensured that the cylinder is always guided centrally.

In accordance with a further feature of the invention, the ball cup, located in the upper zone of the pipe centered in the beam, is centered by bearing against the inside of the beam, and the ball cup that bears against the bottom of the piston in the lower zone of the pipe is arranged to fit against the inner wall of the piston.

In this way the upper ball cup is held at the center of the press, whereas the lower ball cup can participate in the transverse movements to which the bottom of the piston is subjected.

In accordance with a still further feature of the invention, the centrally arranged pipe is provided with a shoulder which lies in a complementary recess in the piston, in the case in which the pipe is screwed into the beam, or in a recess in the beam, if the pipe is screwed into the bottom of the piston.

Normally, the piston is pressed firmly against the beam, by way of the ball cups and the bearing member, by the hydraulic pressure between the bottom of the piston and the cylinder. The provision of a shoulder at that end of the pipe remote from the screw-threaded portion results in the piston, together with the ball cups and the bearing member, being additionally secured.

Certain limits are set on the suspension of the hollow piston from the top beam by means of a pipe, which may be rigid or resilient and can therefore absorb the loads, due to eccentric forging forces, by way of a special seal or because of its own resilience. These limits are imposed, on the one hand, by the wall-thickness of the pipe, when elastic deformation occurs, and by the thus prescribed maximum diameter for the bore for supplying pressure medium to the moving cylinder, and on the other hand, by a certain limitation of the operating pressure of the pressure medium. For certain cases, particularly in larger presses, involving the supply of larger quantities of pressure medium to the cylinder per unit of time, and also when high and very high pressures are used, this type of piston suspension and the bore determined by the design, are inadequate.

Therefore, according to a further embodiment of the invention, pins, mounted on spherical surfaces, are provided as the retaining means for the piston, which pins, by way of a flange on the piston, resiliently hold the piston to the top beam and hold it in a freely movable but play-free manner against the ball cups arranged centrally in the piston, on the one hand, and in the top beam, on the other, the bearing member enclosed in the ball cups by way of partly spherical surfaces, also being so held. In this arrangement, the ball cups and the associated bearing member are provided with a bore which supplies the pressure medium, and the bore is sealed off from the exterior by two packing units arranged on the bearing member.

As a result of the freely movably mounted resilient suspension of the main piston by way of known elements, such as ball cups and interposed bearing member, the piston can readily follow changes in the setting of the moving cyclinder in the guides, e.g. skewing or lateral displacement, which changes are determined by the forging operation. The pressure medium can be easily supplied to the cylinder through the bore in the top beam, the ball cups, the bearing member and the bottom of the piston, since the diameter of the bore can be varied to suit requirements and is sealed off from the exterior by the packing units.

Preferably each of the packing units is arranged at the level of the radial center of the spherical face of the bearing member, and in each case a packing support ring is detachably connected to the bearing member. As a result of the packing unit at the level of the center of curvature, very little movement occurs at this point when the bearing member is deflected, i.e. the packing unit is deformed only slightly in this zone. The packing support ring participates in the movement of the bearing member and thus cannot apply any deformation effort to the packing unit.

The resilient biasing means between the pins and the top beam for resiliently suspending the piston preferably consist of spring-washer packs of "Belleville" spring type. These have a suitably steep spring-characteristic curve so as to provide advantageous resilient suspension of the piston on the top beam.

The part-spherical surfaces of the ball cups and of the bearing member preferably lie in the operating medium. As a result of the arrangement of the packing units on the exterior of the bearing member and against the inner surface of the piston, the contact surfaces between the ball cups and the bearing member lie in the operating medium, i.e. in the oil of the hydraulic system, and these surfaces are thus lubricated in an extremely efficient manner.

In the normal layout of the press, for example for an operating pressure of 315 bars and for a corresponding outside diameter of the piston to provide a given pressing force, the use of the piston arrangement in accordance with the invention results in ideal values as regards the division of the diameters, i.e. the bearing member can also be of sufficiently stable construction despite the presence of the bore in it. This also applies when the cylinder is to be filled beforehand under no pressure i.e. if, in this case, a relatively large bore of the duct through the ball cups the bearing member and the bottom of the piston has to be provided.

BRIEF DESCRIPTION OF THE DRAWINGS

Embodiments of the invention will now be explained in greater detail by way of example only with reference to the accompanying drawings, in which.

DETAILED DESCRIPTION

Figure 1:
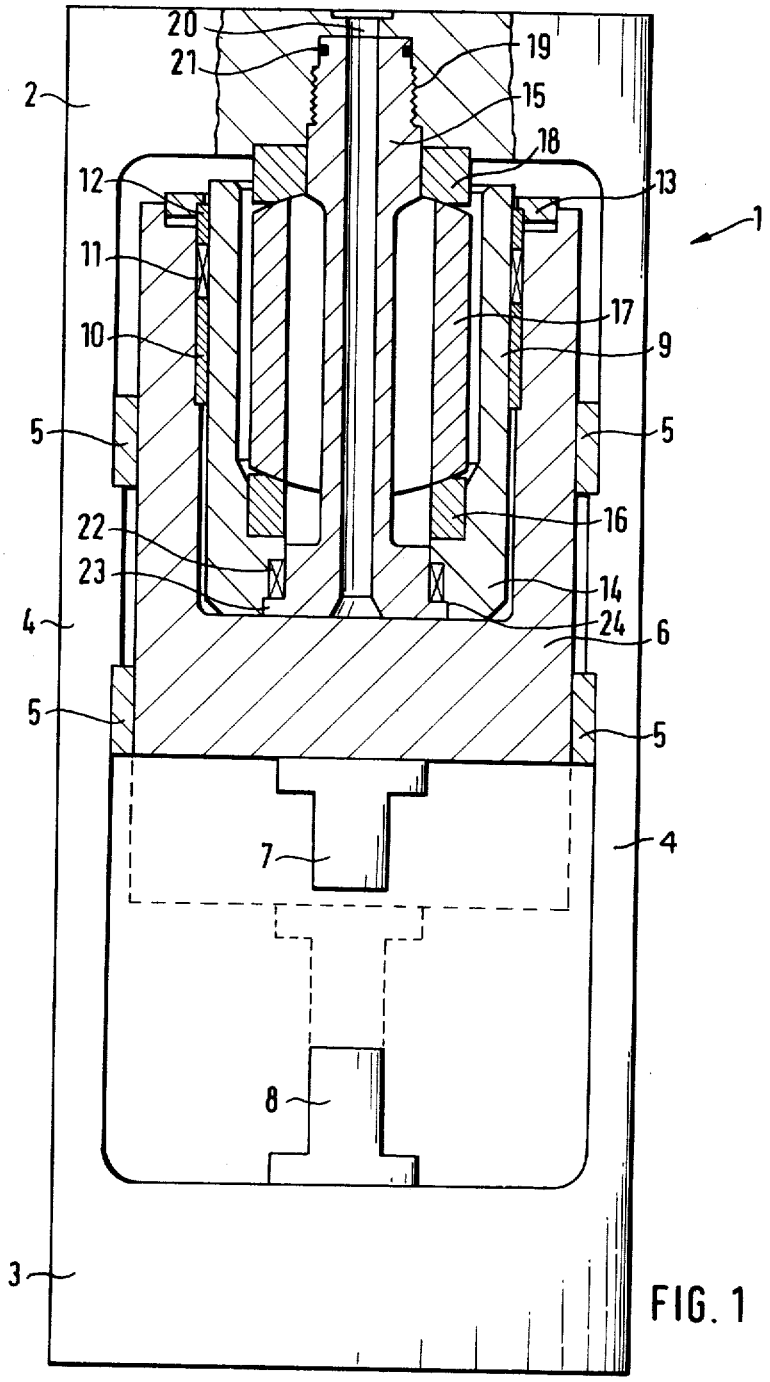
FIG. 1 is an elevational and partly cross-sectional view showing a free-form forging press with a closed frame and in cross-section a moving cylinder with an attached upper tool, and a pipe screwed to the press top beam for supplying pressure medium to the cylinder.

FIG. 1 shows a floor-mounted push-down free-form forging press, with a press frame 1 consisting of an upper beam 2 and a lower beam 3 as well as of two connecting lateral and guide parts 4. A moving cylinder 6 slides in adjustable guides 5 in the press frame. At the bottom, the cylinder carries an upper press tool 7. A complementary lower tool 8 is secured to the lower beam 3.

In the FIG. 1 arrangement, a hollow piston 9 is guided in the cylinder 6 by way of a main bushing 10, a packing unit 11 and a stuffing box 12, arranged in said cylinder, the stuffing box 12 being secured to the end-face of the cylinder 6 by means of a stuffing-box flange 13. Extending through the bottom 14 of the piston is a pipe 15 which passes through bores formed in a lower ball cup 16, a thrust bearing member 17 with spherically convex ends, and an upper ball cup 18, and into the upper beam 2. The pipe 15 is secured in the upper beam 2 by means of an external screw-thread 19. Through a further bore 20 in the upper beam 2, pressure medium can be passed, by way of the interior of the pipe 15, into the space between the bottom 14 of the piston and the cylinder 6. In operation the member 17 acts as a prop or strut transmitting forces from the piston to the top beam.

To prevent loss of pressure medium, a seal 21 is provided between the upper beam 2 and the pipe 15 and a further seal 22 is provided between the bottom 14 of the piston and the pipe 15.

To provide a better hold between the piston 9 and the ball cups 16 and 18 and the member 17 enclosed thereby the centrally arranged pipe 15 is provided with a shoulder 23, which engages in a recess 24 in the bottom 14 of the piston.

The upper ball cup 18 is centered on the lower face of the upper beam 2, whereas the lower ball cup 16, bearing against the bottom 14 of the piston, is fitted on the inner wall of the piston 9.

The pipe shown in FIG. 1 is designed as a "resilient" pipe 15, its wall-thickness being smaller, at least along the length of the member 17, than at the zones where it is fitted to the upper beam 2 and the bottom 14 of the piston. The convex ends of the member 17 have the same radius as the ball cups 16 and 18.

Figure 2:
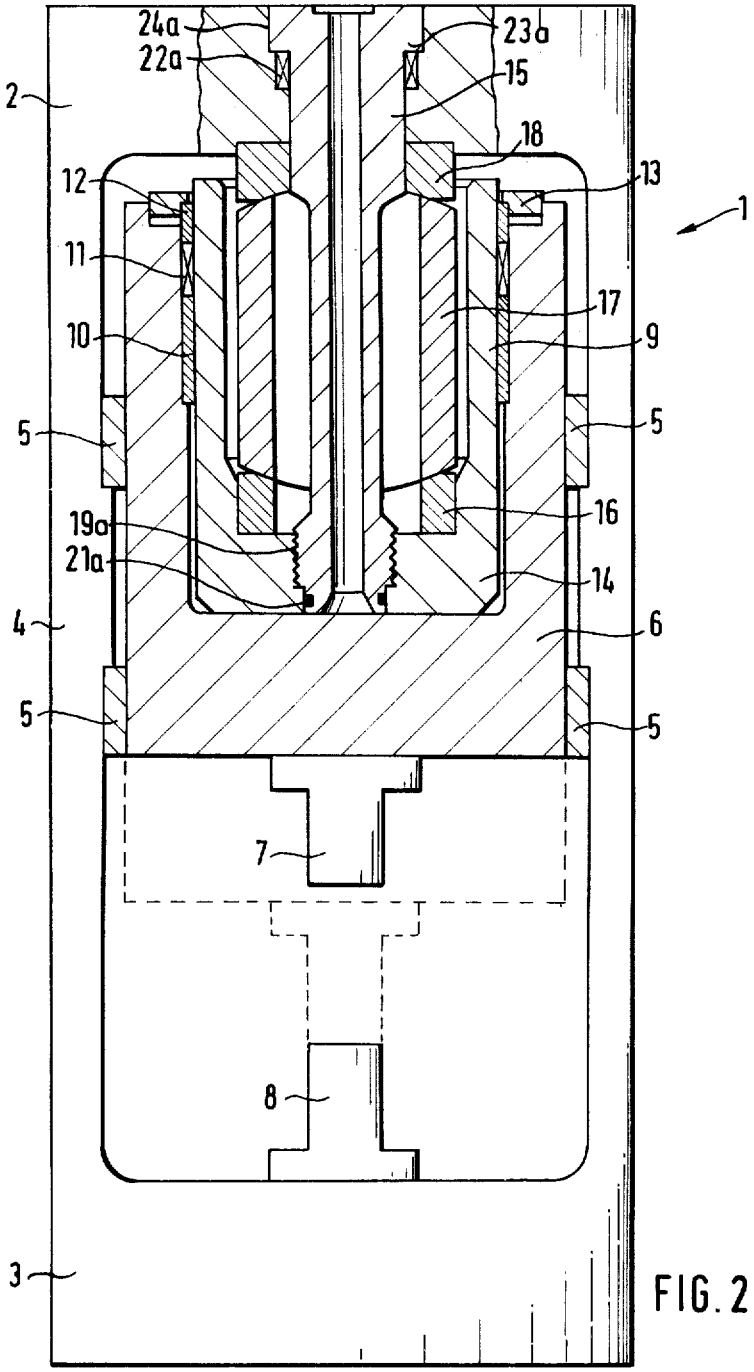
FIG. 2 is a view similar to FIG. 1, but the pipe for the supply of pressure medium screwed into the bottom of the press piston.

FIG. 2 shows a press basically the same as in FIG. 1, but in FIG. 2 the shoulder **23*a* of the pipe 15 lies in a recess 24*a* in the upper beam 2 and the pipe is secured in the bottom 14 of the piston by means of its external screw-thread 19*a*. Provided below the screw-thread 19*a* in the bottom 14 of the piston is a suitable seal 21*a*, and a further seal 22*a* is provided below the shoulder 23*a* in the upper beam 2. In this arrangement, pressure medium is again supplied from the upper beam 2 to the cylinder 6 by way of the interior of the pipe, the seals 21*a* and 22** preventing leakage losses.

As in FIG. 1, FIG. 2 shows, in broken lines, the position of the cylinder 6 and the upper tool 7 on the lower tool 8.

Figure 3:
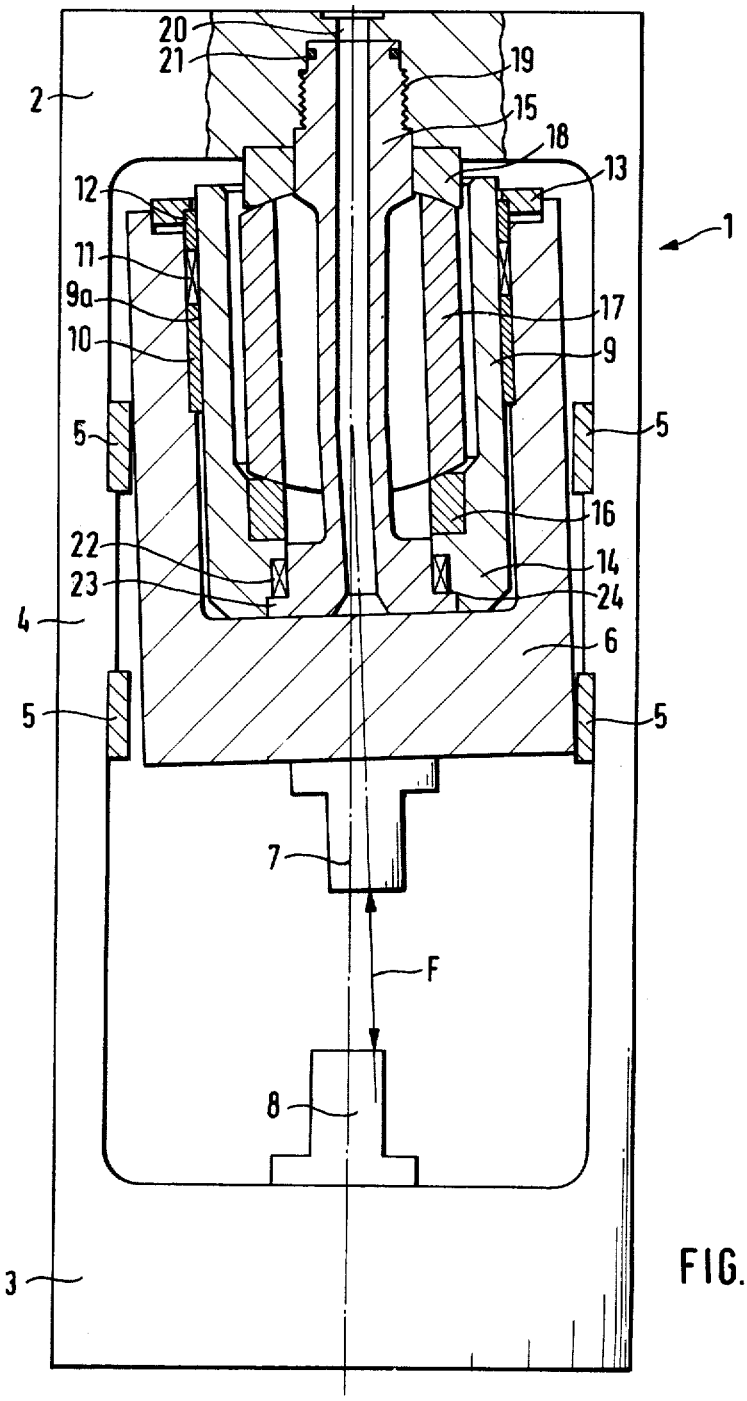
FIG. 3 is a view similar to FIG. 1, but showing the cylinder skewed and the pipe for the supply of pressure medium bent, owing to eccentric loading of the upper tool.

FIG. 3 shows a press as in FIG. 1, but in which an eccentric force F, resulting from the shaping operation, is shown as acting on the upper tool 7, and the effect of this force is that the moving cylinder 6, connected to the upper tool 7, bears heavily against the lower guide 5 at the right and against the upper guide 5 at the left. This moment, which results in skewing of the cylinder 6, is transmitted through the main bushing 10 to the stationary piston 9 and therefore to the pipe 15 which lies in the bottom 14 of the piston by way of the shoulder 23 engaging in the recess 24. The dimensions and particularly the wall-thickness of the pipe are such that it is able to take up this deformation in a resilient manner, and the pressing force can be transmitted to the upper beam 2 through the bottom 14 of the piston, the ball cups 16 and 18 and the member 17 enclosed between the cups. The supply of pressure medium by the pipe 15 which resiliently takes up the skewing and lateral movement of the cylinder 6 is not impeded. The moment applied by the pressing force has no disadvantageous effect upon the main bushing 10, the stuffing box 12 and the surface **9*a*** of the piston.

Figure 4:
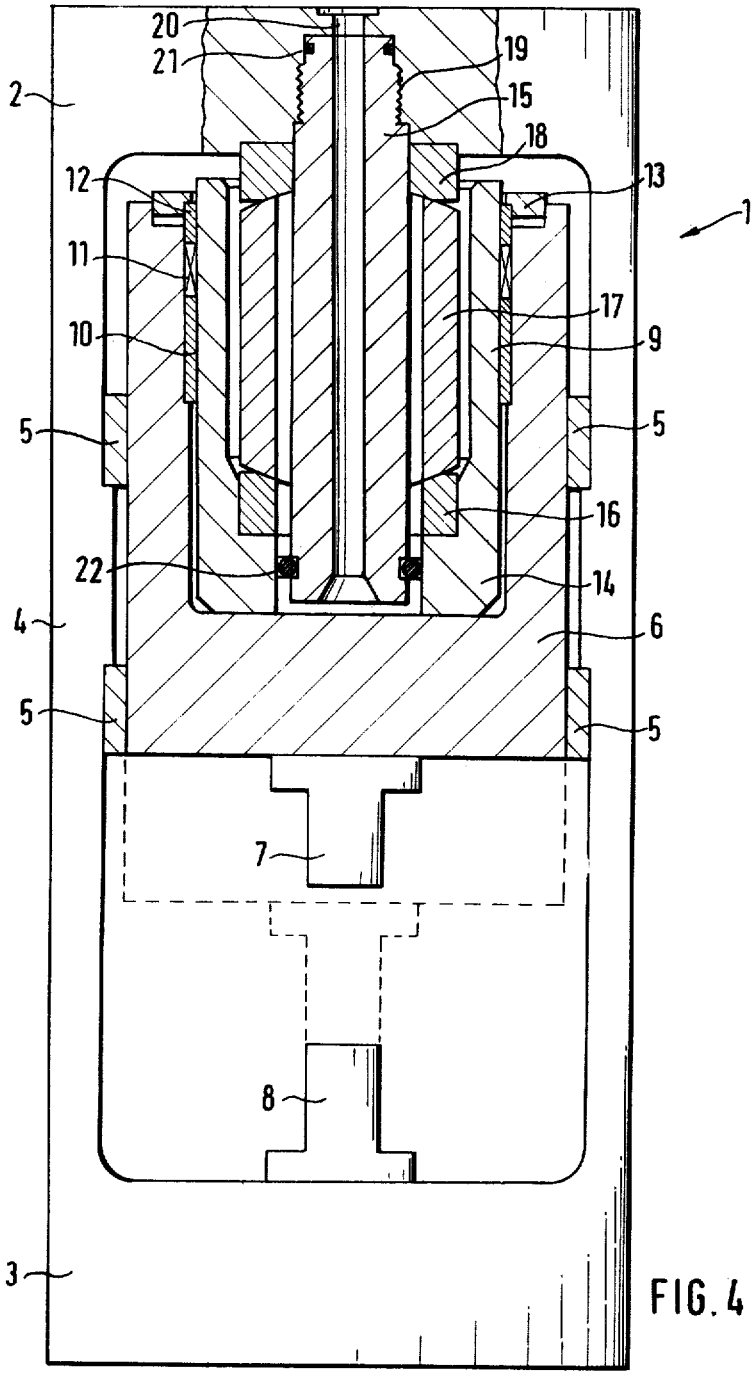
FIG. 4 is a view similar to FIG. 1, but showing a rigid pipe for the supply of pressure medium.

FIG. 4 shows a similar arrangement to FIG. 1 with a pipe 15, screwed into the upper beam 2, and the seal 21. In the FIG. 4 arrangement however, the pipe 15 is rigid and has a correspondingly greater wall thickness. The seal 22 between the pipe 15 and the bottom 14 of the piston is formed as a resilient element which takes up the eccentric loads and skewing resulting from the working process, as well as lateral displacement of the cylinder, force being transmitted through the guide bushing 10 to the piston 9. The outer surface of the lower ball cup 16 fits against the inner wall of the piston 9, so that here again the pressing forces can be transmitted to the upper beam through the ball cup 16, the member 17 and the ball cup 18 when these elements are suitably set relatively to each other.

Figure 5:
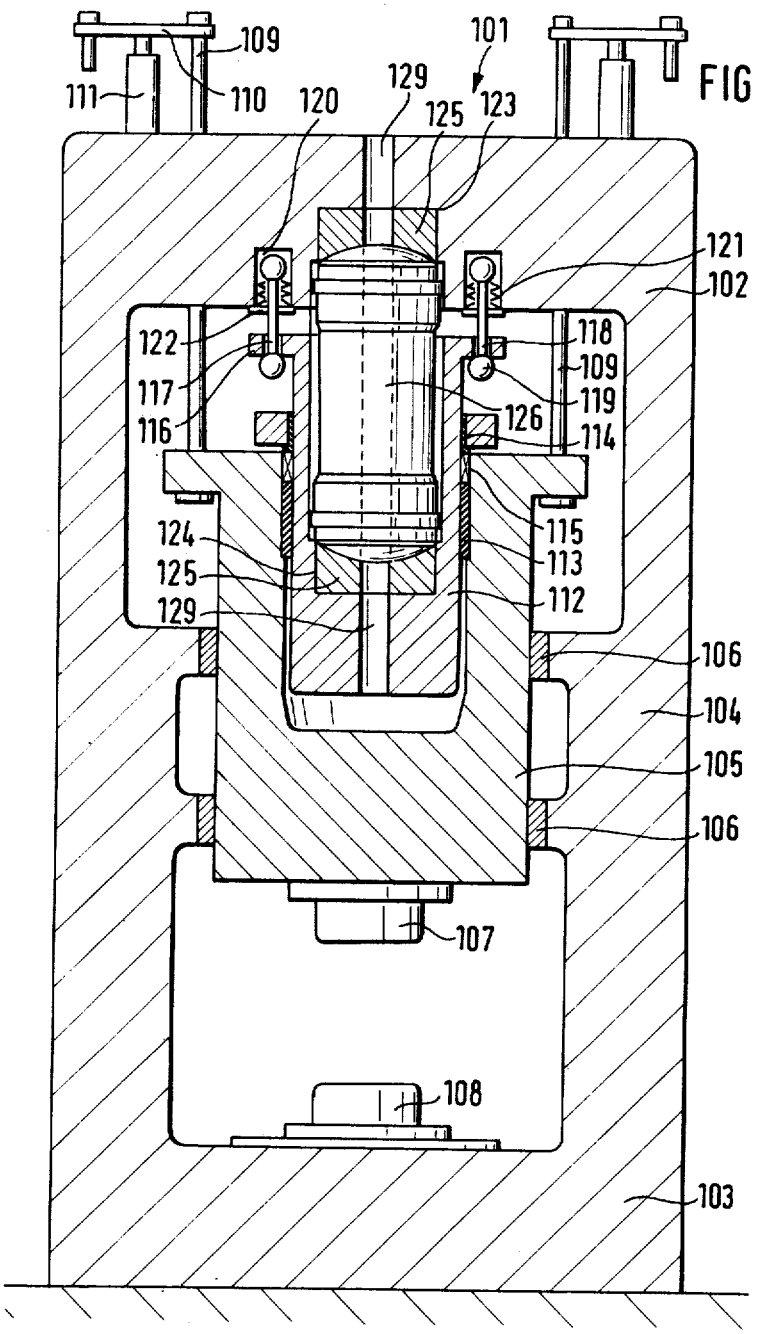
FIG. 5 is a vertical cross-sectional view showing a frame-type floor-mounted forging press with a moving cylinder and a freely movably braced main piston.

The further FIGS. 5 to 8 illustrate another arrangement of the movable piston on the upper beam of the forging press, which arrangement will now be described:

FIG. 5 shows a floor-mounted forging press 101 of the frame type and comprising an upper beam 102 and a lower beam 103 as well as side parts 104 which interconnect the beams and are designed as guides. A moving cylinder 105 is centrally guided on the side parts 104 in adjustable or fixed guides 106. An upper tool 107 is arranged directly at the bottom of the cylinder 105. A corresponding lower tool 108 is secured to the lower beam 103.

Retraction rods 109, which are connected through cross-bars 110 to retraction cylinder units 111 arranged on the upper beam 102, engage the cylinder 105. A main piston 112 slides in the moving cylinder 105; this piston is guided by way of a main bush 113, provided in the cylinder 105, and is sealed in the cylinder 105 by a packing unit 115 held between a stuffing box 114 and the main bush 113.

Located on the main piston 112 is an upper piston flange 116 which is provided with bores 117. Pins 118, to both ends of which a ball 119 is secured, pass through these bores 117. The main piston 112 is swivelly suspended by way of the lower balls 119. The piston is suspended by means of spring-washer packs 121, which are located in bores 120 in the upper beam 102 and which are retained by means of plates 122 secured on the upper beam 102. The main piston 112 is suspended by way of spherical surfaces from the spring-washer packs 121 with the aid of the pins 118 having the balls 119 at their ends. The main piston 112 is resiliently biased against the upper beam 102 by way of upper and lower ball cups 125, provided between a recess 123 in the upper beam and a further recess 124 in the main piston 112, a spherically-ended bearing member 126 being enclosed between the ball cups. The spring-washer packs 121 are so designed that they are able to carry and take up a multiple of the load resulting from the weight of the main piston 112, the ball cups 125 and the member 126 and the friction occurring in the guides. This results in the condition that the spring biased parts—the main piston 112, the upper and lower ball cups 125, with the member 126 enclosed between them, and the upper beam 102—lie one upon the other with no play between them. Thus, the known phenomenon whereby parts that lie loosely one upon the other are subjected to a rhythmic hammering effect under pressure is taken into account.

Figure 6:
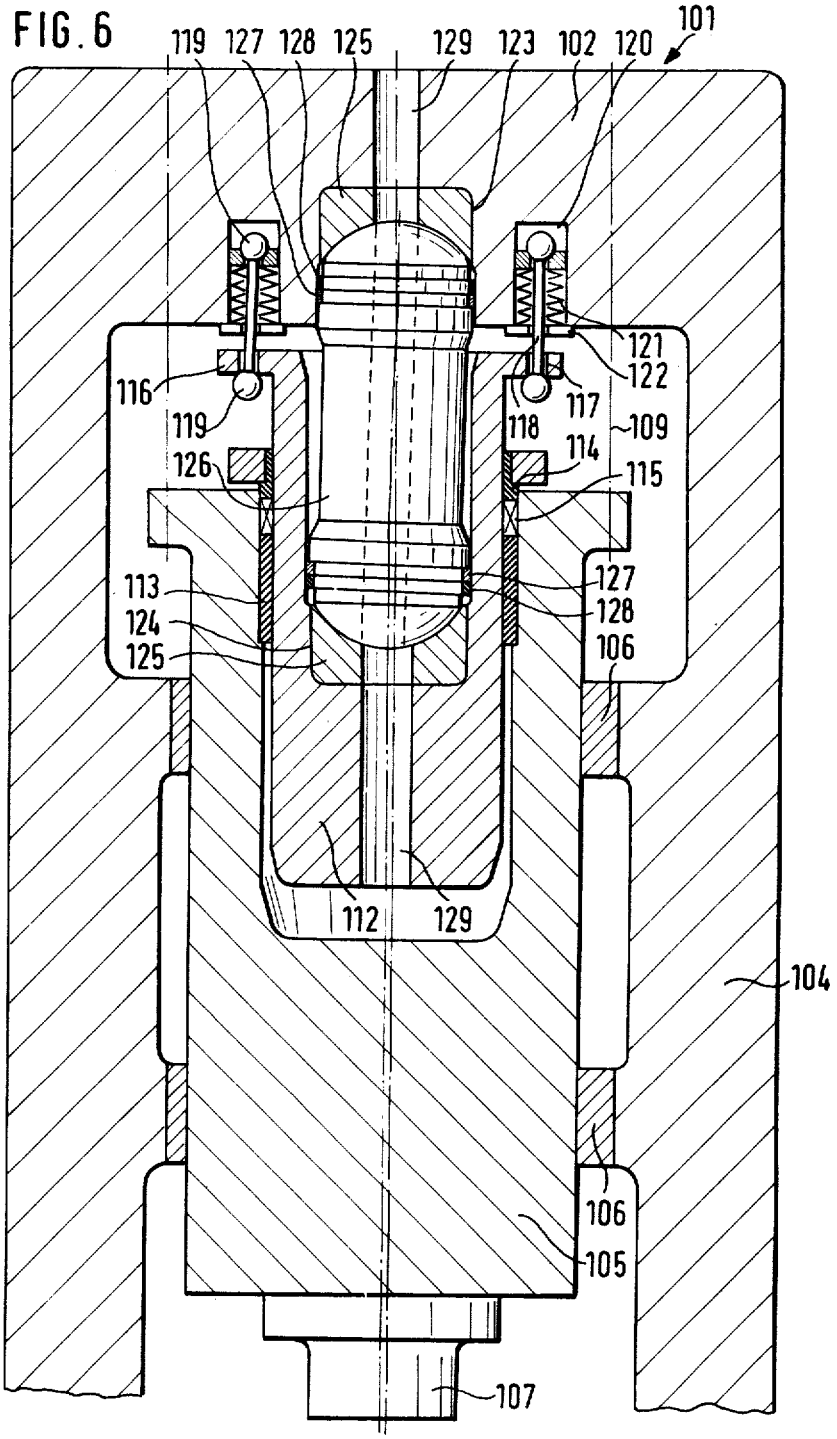
FIG. 6 is a view similar to FIG. 5, but on a larger scale and omitting the lower beam, showing the moving cylinder laterally offset relatively to the outer guides.
Figure 7:
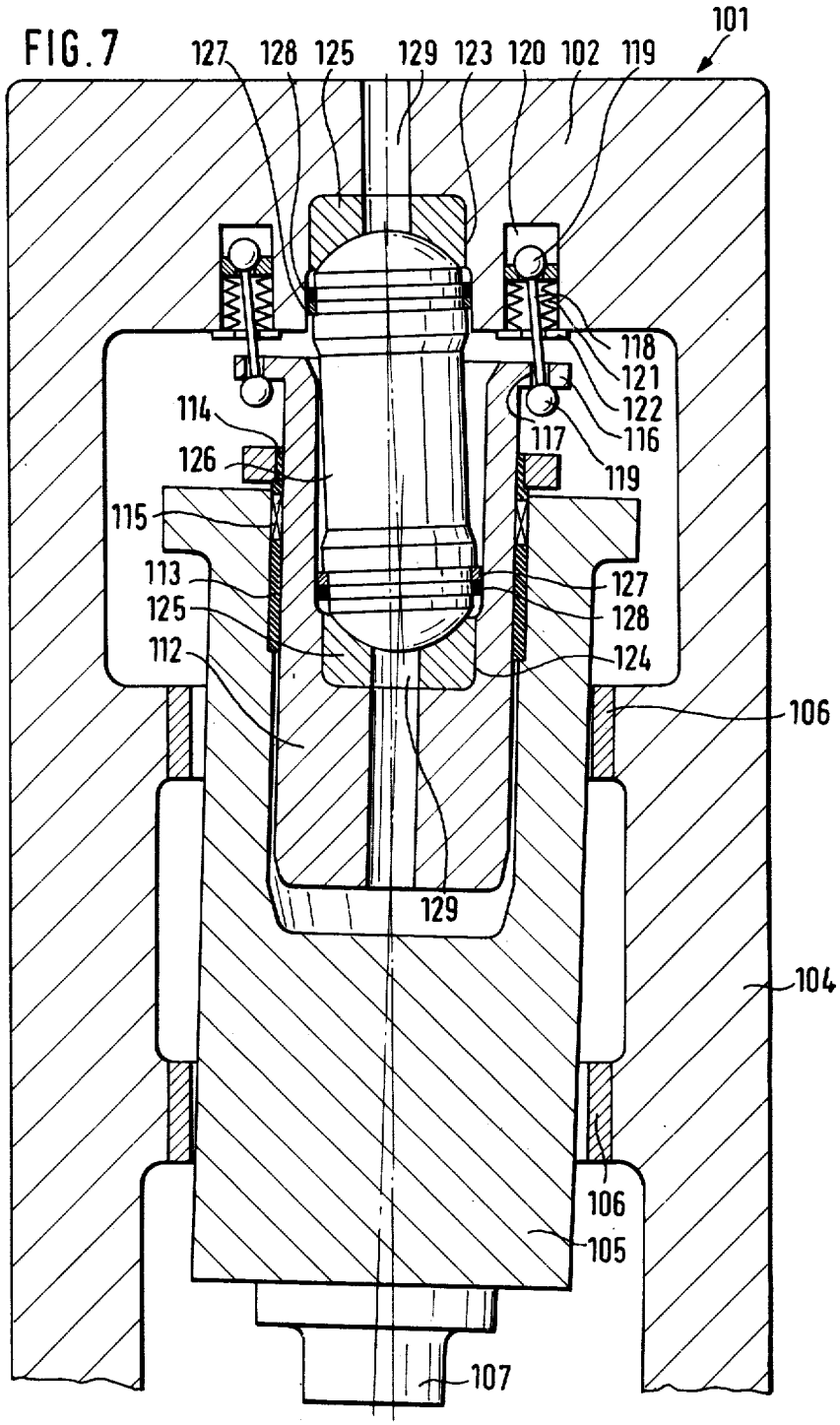
FIG. 7 is a view similar to FIG. 5, but on a larger scale and omitting the lower beam, showing the moving cylinder in a skewed position in the outer guides.
Figure 8:
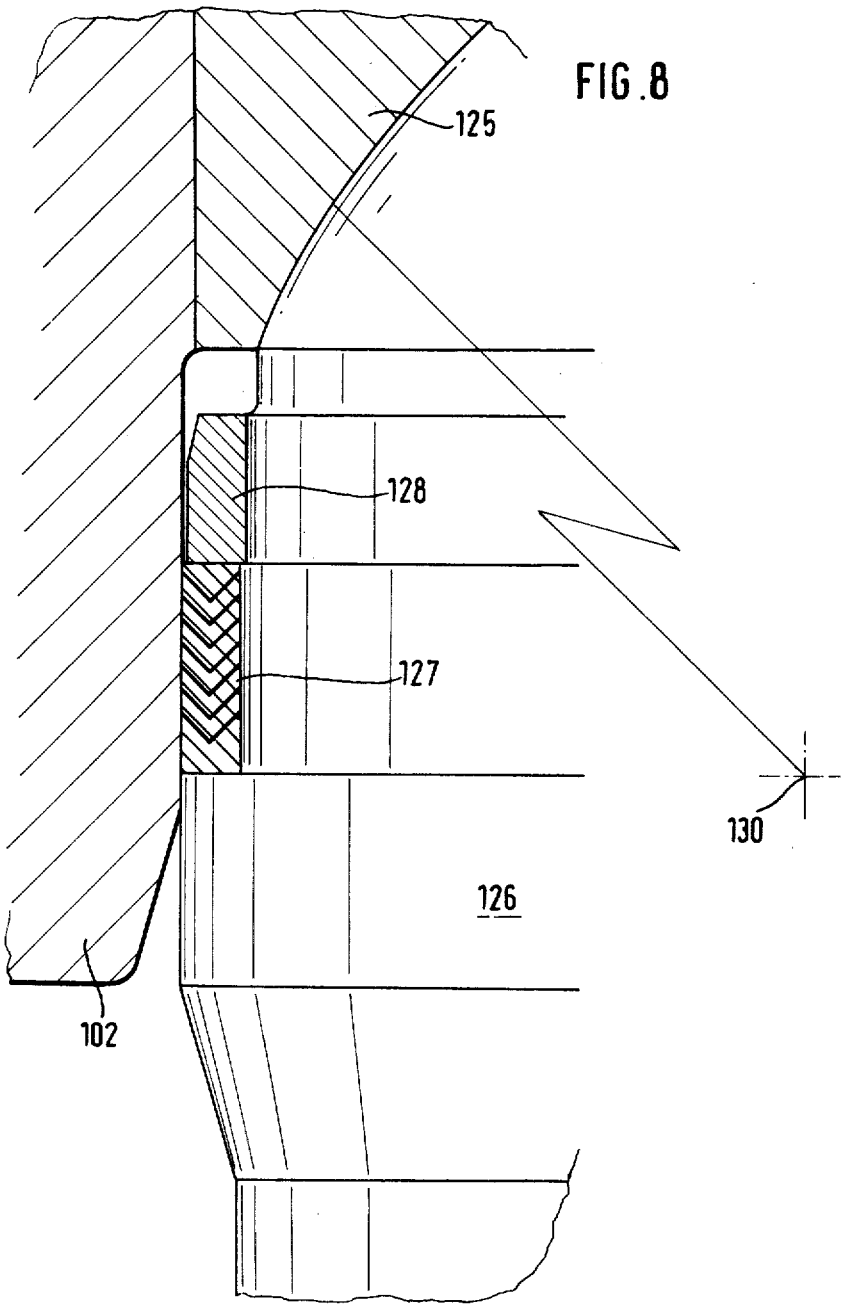
FIG. 8 is a view similar to, but on a larger scale than FIGS. 6 and 7, showing a portion of the upper beam of the press, i.e. the upper parts of a bearing member and of a top ball cup.

The member 126, which at both ends is mounted in the ball cups 125 by way of spherical surfaces, is provided at each of its two ends with a peripheral packing unit 127, which is retained by a packing support ring 128, which is arranged at the ends facing the spherical extremities of the member 126 (FIG. 6 to FIG. 8).

A bore 129 extends from the upper beam 102 to the moving cylinder 105 by way of the upper ball cup 125, the member 126, the lower ball cup 125 and the lower part of the main piston 112. This bore 129 serves to supply operating pressure medium. By arranging the packing unit 127 on the member 126 so that the cavities are sealed off from the exterior, the operating pressure medium can be supplied through the bore 129. The mating faces of the member 126 and the ball cups 125 are exposed to the pressure medium.

FIG. 6 illustrates, on a larger scale, the upper part of the floor-mounted forging press 101, the lower beam 103 and the lower tool 108 being omitted from the drawing. This figure shows in particular a leftward lateral displacement of the lower end of the cylinder 105 from the central position. Because of its resilient swivelling suspension, the main piston 112 matches this position of the cylinder 105 without any particularly great tilting occurring in the main bushing 113. Because of the presence of the bore 129 passes through the ball cup 125 and the member 126, and follows the lateral displacement of the main piston 112, supply of operating pressure medium is ensured in each case.

FIG. 7 shows on the same scale as FIG. 6 the same part of the floor-mounted forging press 101. In FIG. 7, however, the moving cylinder 105 is shown as being skewed as the result of eccentric forces. In the lower guide 106, the cylinder 105 has been pressed to the left away from the guide and in the upper guide 106 it has been pressed to the right (the deflection being exaggerated in the drawing). Here again, because of its resilient suspension and bracing relatively to the upper beam 102, the main piston 112 is able to occupy this skewed position without excessive stress on the main bushing 113 and the packing unit 115 and the stuffing box 114. Since the member 126 is also able to occupy the skewed position, the supply of operating pressure medium through the bore 129 to the cylinder 105 is always ensured.

FIG. 8 shows, on a still larger scale than that of FIGS. 6 and 7, parts of the upper beam 102, of the upper ball cup 125 and of the member 126. The packing unit 127 is disposed precisely level with the center point 130 of the radius of the part-spherical end of the member 126. The packing support ring 128, detachably secured on the member 126, secures the packing unit 127. As a result of this arrangement of the packing unit 127 at the level of the center of curvature 130 of the part-spherical end of the member 126, extremely small movement occurs in this zone upon deflection of the member 126, i.e. the packing unit 127 is only slightly deformed at this point.

To summarize, it should be noted that in all the cases illustrated in FIGS. 6 to 8, the main piston 112 follows the outer setting of the cylinder 105 while the member 126 occupies an angular position. Depending upon the setting, it dwells in this position or corrects its position during the stroke of the cylinder 105. In the event of a pitching movement of the cylinder 105, caused by play in the guides and eccentric forces, the member 126 likewise corrects its position. Because of the effective lever arms in conjunction with the unavoidable frictional locking in the ball cups 125, the forces occurring in guiding the main piston 112 remain within tolerable limits.

We claim:

1. A floor-mounted forging press comprising a press frame, a top beam on said frame, a vertical hollow piston, piston supporting means for supporting said piston on said top beam stationary relative thereto in the direction of the press stroke, a vertically movable cylinder slidably mounted on said piston, a tool being mountable on said cylinder, an upper downwardly facing ball cup mounted on the top beam, a lower upwardly facing ball cup mounted in a lower region of the interior of the hollow piston, a bearing member interposed between said ball cups for transmitting axial loads while allowing said piston to tilt relative to said top beam, and a conduit means connected to the top beam and extending through the top beam and the interior of the piston for supplying a pressure medium to the interior of the cylinder, and sealing means between said conduit and said top beam and piston.

2. A floor-mounted forging press as claimed in claim 1 and further comprising a bore in said top beam, and wherein said conduit means and said piston supporting means comprises a pipe member disposed centrally along the axis of the cylinder and located in said bore in the top beam of the press and extends through said ball cups and bearing member, said bearing member being hollow, and through the bottom of the hollow piston, said bottom of said piston adjoining said lower ball cup, a seal between said pipe member and said bore in the top beam and a further seal between said pipe member and the bottom of the piston, said pipe member being secured in at least one of the top beam and bottom of the piston.

3. A floor-mounted forging press comprising a press frame, a top beam on said frame, a bore in said top beam, a vertical hollow piston, a substantially rigid pipe member mounted in said top beam in said bore and in said piston for supporting said piston on said top beam stationary relative thereto in the direction of the press stroke, a vertically movable cylinder coaxially slidably mounted on said piston, a tool being mountable on said cylinder, an upper downwardly facing ball cup mounted on the top beam, a lower upwardly facing ball cup mounted in a lower region of the interior of the hollow piston, a hollow bearing member interposed between said ball cups for transmitting axial loads while allowing said piston to tilt relative to said top beam, said pipe member extending through said ball cups, and bearing member, and centrally and coaxially with respect to said piston and cylinder and through the bottom of said piston, and being secured in at least one of said top beam and bottom of the piston, said bottom of the piston adjoining said lower ball cup, a seal between said pipe member and said bore in the top beam and a further seal between said pipe and said bottom of the piston, one of said seals being deformable to accommodate skewing and lateral displacement of the piston resulting from the operation of the press.

4. A floor-mounted forging press comprising a press frame, a top beam on said frame, a vertical hollow piston, a substantially rigid pipe member mounted in said top beam in said bore and in said piston for supporting said piston on said top beam stationary relative thereto in the direction of the press stroke, a vertically movable cylinder coaxially slidably mounted on said piston, a tool being mountable on said cylinder, an upper downwardly facing ball cup mounted on the top beam, a lower upwardly facing ball cup mounted in a lower region of the interior of the hollow piston, a hollow bearing member interposed between said ball cups for transmitting axial loads while allowing said piston to tilt relative to said top beam, said pipe member extending through said ball cups and bearing member and centrally and coaxially with respect to said piston and cylinder and through the bottom of said piston, and being secured in at least one of said top beam and bottom of the piston, said bottom of said piston adjoining said lower ball cup, a seal between said pipe member and said bore in the top beam and a further seal between said pipe member and said bottom of the piston, said centrally arranged pipe member being of such dimensions that skewing and lateral displacement of the piston resulting from the operation of the press can be taken up by deformation within the elastic range of the pipe member.

5. A floor-mounted forging press as claimed in claim 3 or 4 wherein said upper ball cup is located in the upper zone of the pipe member, which is centered in the top beam, and said upper ball cup is centered by bearing against the inner side of the top beam, and the lower ball cup bears against the bottom and inner wall of the hollow piston adjacent the lower zone of the pipe member.

6. A floor-mounted forging press according to any one of claims 2, 3 or 4 wherein said centrally arranged pipe member is provided at its lower end with a shoulder, a complementary recess is provided in the bottom of the piston to receive said shoulder, and the upper end of the pipe member is secured in the top beam by a screw thread.

7. A forging press according to any of claims 2, 3 or 4 wherein said pipe member has a shoulder at its upper end, a complementary recess is provided in the top beam to receive said shoulder, and the lower end of said pipe member is screwed into the bottom of the piston.

8. A floor-mounted forging press comprising a press frame, a top beam on said frame, a vertical hollow piston, support means for supporting said piston on said top beam stationary relative thereto in the direction of the press stroke, a vertically movable cylinder slidably mounted on said piston, a tool being mountable on said cylinder, an upper downwardly facing ball cup mounted on the top beam, a lower upwardly facing ball cup mounted in a lower region of the interior of the hollow piston, a bearing member interposed and spherically located between said ball cups for transmitting axial loads while allowing said piston to tilt relative to said top beam, coaxial conduit means through the top beam and the interior of the piston for supplying a pressure medium to the interior of the cylinder, an upper flange on said piston, said supporting means comprising spherically located pins engaging said flange and coupled to the top beam and resilient biasing means for urging the piston towards the top beam thereby ensuring free-play engagement between said piston, bearing member, ball cups and top beam, while allowing free movement of the piston, the ball cups being disposed centrally in the piston and on the top beam respectively, coaxial conduit means for supplying pressure medium to the interior of said cylinder comprising communicating passages through said top beam, ball cups, bearing member and interior of said piston, and peripheral sealing means on said bearing member adjacent each end thereof for sealing said passages from the surrounding atmosphere.

9. A forging press as claimed in claim 8 wherein said bearing member has at its upper and lower ends respective part-spherical convex surfaces seated in respective ball cups, each said peripheral sealing means is level with the center of curvature of the adjacent said convex surface and a peripheral sealing means support ring is detachably connected to the bearing member adjacent each end thereof.

10. A forging press as claimed in claim 8 or 9 wherein said resilient biasing means comprises respective packs of spring washers provided between said pins and the top beam for urging said pins upwardly.

11. A floor-mounted forging press according to claim 8 or 9, wherein said ball cups have part-spherical concave surfaces and said part spherical surfaces of the ball cups and bearing member lie in the operating pressure medium.

12. In a floor-mounted forging press having a press frame, a top beam on said frame, a stationary hollow piston mounted on the top beam in the forging direction, a cylinder slidably mounted on the piston to produce the forging stroke, a toolholder mountable on the cylinder, a coaxial bore for supplying pressure medium to the moving cylinder extending through the top beam and the piston, the improvement comprising ball cups fitted between the bottom interior of the piston within the cylinder and the top beam, a bearing member operatively engaged between said ball cups so that said piston is articulatedly mounted to said top beam, piston support means for supporting said piston on the top beam, said pressure medium supply bore comprising, a bore in the top beam and a conduit connected to said top beam and extending from said bore through said piston, and sealing means is provided between said conduit and said top beam and between said conduit and said piston.

* * * * *